United States Patent [19]

Westdale et al.

[11] 4,248,950

[45] Feb. 3, 1981

[54] ELECTROSTATIC DEVELOPER MIX CONTAINING EITHER $MOS_2$, $TIS_2$, $WS_2$ OR GRAPHITE AS LUBRICANT

[75] Inventors: Virgil W. Westdale, Chagrin Falls; Charles A. Kumins, Gates Mills, both of Ohio

[73] Assignee: AM International, Inc., Los Angeles, Calif.

[21] Appl. No.: 570,279

[22] Filed: Apr. 21, 1975

Related U.S. Application Data

[63] Continuation-in-part of Ser. No. 362,981, May 23, 1973.

[51] Int. Cl.[2] ..... G03G 9/10

[52] U.S. Cl. ..... 430/31; 430/110; 430/120; 428/407

[58] Field of Search ..... 96/1.5 D; 252/62.1, 252/12; 29/192 R, , 192 CP, 198; 430/110, 120; 428/407

[56] References Cited

U.S. PATENT DOCUMENTS

| | | | |
|---|---|---|---|
| 3,234,017 | 2/1966 | Heyl et al. | 252/62.1 |
| 3,246,148 | 4/1966 | Troeyer et al. | 252/62.1 |
| 3,377,286 | 4/1968 | Stricklin | 252/62.1 |
| 3,533,835 | 10/1970 | Hagenbach et al. | 252/62.1 |
| 3,752,666 | 8/1973 | Hagenbach et al. | 252/62.1 |
| 3,779,926 | 12/1973 | Merck et al. | 252/62.1 |

*Primary Examiner*—John D. Welsh

*Attorney, Agent, or Firm*—A. W. Karambelas; R. C. Curfiss

[57] ABSTRACT

A dry electrostatic developer mix having improved fatigue-resistance properties, is realized by adding to the developer mix, which contains carrier particles and pigmented toner particles, molybdenum disulfide in amounts ranging from about 0.005% to about 1.0% preferably in the range of from about 0.009% to about 0.2% based on the weight of carrier particles present in the developer mixture.

9 Claims, No Drawings

ELECTROSTATIC DEVELOPER MIX CONTAINING EITHER $MOS_2$, $TIS_2$, $WS_2$ OR GRAPHITE AS LUBRICANT

This application is a continuation-in-part of application Ser. No. 362,981, filed May 23, 1973.

BACKGROUND OF THE INVENTION

This invention relates to a dry developer mix for developing charge patterns created by means of electrophotographic imaging techniques and, more particularly, the invention relates to a developer mix of the character described, having improved fatigue resistance and imaging properties.

In the practice of electrophotographic processes, an electrostatic charge is produced on the surface of a photoconductive member. The construction of these photoconductive members is well known, and one example of such photoconductive members involves the use of inorganic photoconductive metal ion containing crystalline materials, which are dispersed in a resin binder. The compounds which may be used in the instant invention and which fall within this definition of photoconductive insulating compounds are zinc oxide, zinc sulfide, zinc-cadmium sulfide, zinc-magnesium oxide, cadmium selenide, zinc silicate, calcium-strontium sulfide and zinc titanite.

In addition to inorganic photoconductive compounds, the photoconductive member may be formed by using organic photoconductive materials, which in themselves are film forming and may not require an insulating resin binder. Such materials as polyvinylcarbazole, polyacryloylcarbazole, polyacryloylbenzocarbazole, vinyl copolymers containing vinylcarbazole units.

It will be understood that the actual formation of the photoconductive member comprises no part of the instant invention and, therefore, will not be discussed in greater detail.

The charge pattern or latent image is created on the photoconductive member by first exposing the charged surface to a pattern of light and shadow wherein the light rays affect the discharge of the exposed portions of the surface while the portions of the photoconductive layer corresponding to the shadow portions retained the charge. The resulting latent image is then rendered visible by applying thereto toner particles, which are attracted to the charge portions of the surface or the image portions.

The mechanisms of the development of the latent electrostatic images, as a technique, are well-known. Depending on the type of photoconductive member it will be imparted a blanket electrostatic charge which is either positive or negative. It will then be exposed to a pattern of light and shadow and developed with a developer mix in which the charge orientation of the toner particles, as they are applied from the developer mix, will appropriately be attracted to the image portions of the electrostatic latent image. Such electroscopic powders may be utilized to develop positively charged images as well as being attracted to those portions which are light exposed by virtue of the charge orientation of the toner particle.

Having rendered the electrostatic charge pattern visible on the photoconductive member the final copy may be produced in one of two ways. In the circumstance that the photoconductive member itself is to be the final copy then the powder image is fixed directly on the photoconductive surface by heating the member causing the thermoplastic resin particles to coalesce, or, it may be fixed onto the photoconductive member by pressure, or it may be fixed by high intensity flash radiations such as that produced by a xenon radiation source, or by exposing the thermoplastic resin to solvent vapors which will cause the material to partially dissolve and flow together. Other techniques call for the transfer of the powder image from the photoconductive layer to a plain paper receiving sheet or other suitable receiving member and the transferred powder image is fixed thereon by any one of the previously mentioned techniques.

The two principal ingredients of a dry developer mix are the toner particles and the carrier particles. The toner and carrier particles coact with one another so that there is produced a tribo-electric charge causing the carrier and toner particles to be attracted to one another. It is by this technique, whereby tribo-electric charge is developed on the toner particle, that causes it to be attracted to the charge pattern on the photoconductive surface by a force which is greater than the tribo-electric force which holds it to the carrier particle.

It is to be understood that the benefits of the instant invention are to be realized by applying it to developer mixes which can be used in the environment of a magnetic brush or a cascade system or any other system wherein the carrier and the toner particles are dissimilar materials permitting the development of the tribo-electric charge. While the instant invention is described in the environment of a magnetic brush system, which depends on the use of magnetically attractable carrier particles, it is intended that it not be limited thereto and could be used to equal advantage where the carrier particles are glass beads or any other material.

The conventional electrostatic systems in use today generally keep the developer mix in a closed system. This means that the materials are recirculated from a supply source to the developing station and the unused materials are returned to the supply system and thereby recycled. The toner particles are consumed from the developer mix upon being attracted to the image portions of the electrostatic copy. Consequently, the concentration of toner in the developer mix becomes depleted, that is, the concentration of toner to carrier during the course of the reproduction or duplicating cycle changes. It therefore becomes necessary to replenish the amount of toner in the developer mix in order that the proper level of concentration be maintained in order to optimize the performance of the developer mix.

Understandably, the replenishment of the carrier materials occurs much less frequently since the carrier itself is not consumed in the process. However, there is some loss of the carrier and it, too, requires replenishment.

One of the serious deficiencies of the dry electrostatic developer mixes is the tendency for the mix to "fatigue". A developer mix will be recognized as becoming fatigued when it fails to perform in the following described manner. There occurs a significant fall off in the density of the image (degree of blackness) which is produced; that is, a very dense black image tends to become increasingly gray. The contrast begins to degrade whereby the background or non-image area begins to accept toner particles producing a black-on-gray background or a dark gray on a light gray background instead of black-on-white. Attempts on the part of the operator to correct the copy quality by replenishing the supply of toner will have no effect because the system fails to respond to increases in concentration, and at some point it will tend to increase the background. Thus, a fatigued developer mix appears to have lost its all-important properties, namely, to seek out the charge or imaged portions of the photoconductive member as opposed to the non-image or background of the sheet at a reasonable concentration of toner in the system.

U.S. Pat. No. 3,320,169 issued May 16, 1967 to the assignee of the present application recognizes the problem of developer mix fatigue or drop-off as a problem of longevity and discloses that by the addition of certain fatty acids, fatty acid salts and mixtures thereof, the life of a developer mix is increased from the production of 2000 to 6000 copies and even up to 10,000 copies. At the time the development reported in U.S. Pat. No. 3,320,169 was made, the output of the equipment to which the invention was directed was required to make reproductions at a rate of about 8 to 15 per minute.

The advent of higher output equipment, for example those which must produce in the range of from 40 to 60 copies per minute, has imposed still greater stress and made still greater demands on the formulation of developer mixes and has greatly intensified the problem of mix fatigue than had been experienced by the equipment up to that time.

It will be appreciated that these systems are recycled so that the movement of the developer mix through the developer system, whether it be cascade or magnetic brush system, is tumbled at a rate which is commensurate with the speed of movement of the copy sheet through the equipment. Accordingly in a machine which turns out 60 copies per minute, the developer will be moving 3 to 4 times as fast than a machine which is producing 8 to 15 copies a minute. An increase of 400 and 500% in the rate of movement of this developer has subjected the developer mixes to much greater stresses and forces which cause the fatigue of the materials. It is theorized that at these great speeds the toner particles experience further comminution, which is one reason why they tend to lose their charge orientation. The carrier itself tends to have permanently bonded onto its surface, due to the pressures involved, the thermoplastic materials so that the proper degree of tribo-electric force to be developed suffers greatly since the carrier is now coated with the same material as the toner particle itself.

The use of the fatty acids and the metal salts of the fatty acids has served well the cause of controlling fatigue but in the environment of such high production machines has been found to be depleted more rapidly from the system. This requires the use of high concentrations of the metal soaps which, it has been found, could interfere with the orientation of the toner, and in addition, requires higher temperature to fix the powder to the base support.

It is therefore apparent that there is a need for dry developer mixes having improved fatigue resistance, especially in the environment of the high output duplicating and copy machines. The present invention is addressed to filling this need.

SUMMARY OF THE INVENTION

In accordance with the present invention, a conventional developer mix is augmented to provide it with improved fatigue resistance by incorporating therein a minor proportion of a dry, inorganic lubricant such as a metal disulfide, graphite and lead oxide. Of the useful metal disulfides, molybdenum disulfide, tungsten disulfide and titanium disulfide can be utilized to good advantage. The preferred metal disulfide is molybdenum disulfide.

The reference herein to conventional developer mixes includes those dry developer mixes which lend themselves to either the cascade-type development systems or magnetic brush development systems. Both systems rely on the development of an electrostatic charge on the toner particle, relative to the carrier particle through the action of triboelectric forces. The mechanism of development with either system is the same, the main differences residing in the technique of flowing developer mix or otherwise making it contact the latent electrostatic bearing image on the copy material. The magnetically attractable carrier particles are utilized with magnetic brush systems for the reason that magnetic fields are employed to form the developer mix into a brush-like mass for application to the electrostatic latent image. Both of these systems are well known in the art and will not be discussed in further detail herein, it being understood that the advantages to be realized from the use of the additive of this invention can be used in either cascade or magnetic brush development systems.

In accordance with a specific and preferred aspect of the present invention there is provided, in a dry developer mix for developing electrostatic latent image on photoconductive insulating material, comprising carrier particles and pigmented thermoplastic resin toner particles, an additive selected from molybdenum disulfide, titanium disulfide, tungsten disulfide, graphite and comprising from about 0.005 to about 1.0 weight percent of the additive, based on the weight of the carrier particles resulting in an improved developer mix capable of resisting fatigue for prolonged periods of time under high-speed duplication conditions.

It is therefore an object of the present invention to provide a developer mix having improved fatigue resistance.

A further object of the invention is to provide a dry developer mix comprising carrier particles and pigmented thermoplastic resin toner particles in a minor proportion of a dry inorganic lubricant, such as a metal disulfide, in an amount sufficient to improve the fatigue resistance of the developer mix under high output duplicating conditions.

A still further object of the invention is to provide a dry developer mix having improved fatigue resistance under high output duplicating conditions wherein magnetic brush developer system is used comprising magnetic carrier particles and pigmented thermoplastic resin toner particles and a minor proportion of a dry inorganic lubricant, such as a metal disulfide.

A still further object of the invention is to provide an improved developer mix having improved fatigue resistance by incorporating therein from about 0.05 to about 1.0 weight percent molybdenum disulfide based on the weight of the carrier particles.

Another specific object of the invention is to provide an improved developer mix having improved fatigue resistance comprising carrier particles and pigmented thermoplastic resin toner particles by incorporating therein about 0.005 to about 1.0 weight percent graphite based on the weight of the carrier particles.

These and other objects in advantage of the present invention would become apparent from the following detailed discussion.

DESCRIPTION OF THE INVENTION

The foregoing objects and advantages of the present invention may be achieved by combining any conventional dry developer mix with a dry additive selected from the group consisting of molybdenum disulfide, tungsten disulfide, titanium disulfide, graphite and lead oxide. In general, developer mixes are comprised of two principal ingredients: carrier particles and pigmented toner particles.

The carrier particles may be of the magnetic type, in which case they are formed ferro magnetic metals such as iron, nickel and cobalt; alloys of such metals, for example steel and metallic compounds such as ferrites. Magnetically attractable carrier particles require those developing systems which employ the magnetic brush.

The non-magnetic type of carrier particles may be glass beads or any suitably dense material which may be coated or otherwise treated to provide the proper triboelectric properties. It is conventional in this art to use glass beads in the circumstance that the developer mix is to be applied to the latent electrostatic image by cascade development techniques. The carrier particles, generally useful in this invention, should have an average diameter within the range of about 25 to about 500 microns, and preferably within the range of about 25 to about 150 microns.

The thermoplastic resin toner particles may be formed from any one of a variety of naturally occurring and synthetic organic thermoplastic resins. Among the naturally occurring resins, wood rosin, asphalt and gilsonite may be used. Among the synthetic resins, polystyrene, polyolefins, polyacrylics, polyvinyls and polyamides are generally represented. The choice of thermoplastic resin will depend, at least in part, on whether or not a toner is to be given permanency by heat fusion, solvent or pressure fixing or a combination of these systems.

The various techniques whereby the toner powder, once it has been deposited on the latent image-bearing surface, is permanently affixed to the surface are well described in this art and will not be dealt with in any further detail in this discussion.

The toner particles are generally smaller than the carrier particles and fall in the range of about 1 to about 75 microns, preferably from about 4 to about 15 microns in average diameter.

It will be appreciated that when using the toner particle for the purpose of rendering an electrostatic latent image visible that they should be highly colored. The coloration of the toners may be accomplished by using a variety of materials to render them visible. For the purpose of this disclosure the term "pigmented" is intended as a generic expression covering all types of coloring matter and not specifically the coloration developed with pigments per se. Black pigmentation of the toner may be accomplished with carbon black or lamp black. Pigmentation in any color may be accomplished through the use of organic dyes. In general, adequate pigmentation can be achieved by incorporating from about 1 to about 5 parts by weight of pigment or dry to about 95 parts by weight of thermoplastic resin. It will be appreciated that in many instances the natural occurring color of the ingredients used in the toner will, itself, provide sufficient color in order to render it visible or "pigmented". However, the addition of other materials such as carbon black and the like, is optional.

The toners are made by melting the thermoplastic resin, adding the pigment to the molten resin, and mixing the ingredients until homogenious. The mixture is then cooled and by grinding the cooled mass, it is reduced to fine particles within the particle size range described hereinabove.

The developer mix is then prepared by mixing the carrier particles, either magnetically attractable or of the glass bead variety, with the pigmented toner particles and the dry inorganic lubricant until the ingredients are uniformly dispersed. In general, the relative proportion of carrier and toner particles should be within the range of from about 10:1 to about 100:1.

The invention contemplates modifying developer mixes which are adapted and capable of rendering visible the charged portions of the latent image-bearing surface corresponding to the image portions on an original, as well as those which can develop those portions which have been exposed to electromagnetic radiation and have been substantially discharged and which further correspond to the image portions on a graphic original.

Thorough mixing of the components of both the negative working developer mix and positive working developer mix is carried out in any suitable equipment to provide a complete mixture of the components. The additive or lubricant appears to intermix and coat both the carrier particles as well as the toner particles, providing the necessary lubricity between the powdered particles and it is this property which is believed to be responsible, in part, for the improved triboelectric characteristics of the developer mix embodying this invention.

It is important that the lubricant remain in the solid phase being thoroughly intermixed with the carrier particles and toner particles, and being uniformly distributed throughout the mixture.

The following examples are given for illustrative purposes, it being understood that this invention is not limited to the specific examples. The percentages which are shown in all of the examples are given on a weight basis.

As previously noted the improvement in fatigue resistance is realized by incorporating a minor proportion of an additive into the developer mix composition. Suitable materials include metal disulfides such as molybdenum disulfide, tungsten disulfide and titanium disulfide. Other dry lubricants which have been used to advantage in the practice of the present invention include lead oxide and graphite.

The preferred material is molybdenum disulfide which is commercially available under the name "Molysulfide" from Climax Molybdenum Company, a division of American Metal Climax, Incorporated.

The additives of the instant invention have been found to provide improved fatigue resistance by incorporating the material in an amount in the range of about 0.005 to about 1.0 weight percent, based on the weight of carrier particles. The preferred range for the additive is from about 0.09 to about 0.015 weight percent, based on the weight of carrier particles.

When using the preferred molybdenum disulfide, improved fatigue resistance results when using concentrations in the range of from about 0.005% to about 1.0 weight % based on the weight of carrier particles, the preferred amount being from 0.009 to about 0.2 weight % based on the weight of carrier particles.

The following examples are presented for illustrative purposes, it being understood that the invention is not limited to these examples. Each of the examples describes a developer mix made up of (A) toners, (B) carrier particles, and (C) additives. In each of the developer mix examples, there is described the ingredients which form the toner. These ingredients are processed using well known techniques to produce the electroscopic particles. The carrier particles can be either magnetically attractable materials such as iron or glass beads. The third ingredient is the additive. In all the examples, the additive C is first thoroughly mixed with the carrier particles to properly coat and disperse the additive onto the carrier. The toner A is added as the last component.

EXAMPLE I

| | | |
|---|---|---|
| A. Toner | | 100 grams |
| Ingredients | % By Weight | |
| Synthetic, Polyamide, Rosin (Versamide 930) | 33. | |
| Polyol (Shell X-450) | 9.9 | |
| Moleic anhydride-polyhydric alcohol resin-modified resin (Amberol 800, Rohm & Haas) | 49.2 | |
| Nubian Resin Black Dye | 6.6 | |
| Carbon Black Pigment (Neo-spectra, Mark II) | 1.0 | |
| B. CARRIER PARTICLES | | 1,000 grams |
| C. Molybdenum disulfide (0.3% based on weight of carrier) | | 3.0 grams |

EXAMPLE II

| | | |
|---|---|---|
| A. TONER | | 10.0 grams |
| Ingredients | % By Weight | |
| Polyamide Rosin (Versamide 930) | 74.0 | |
| Moleic Anhydride-polyhydric alcohol resin-modified resin (Amberol 800) | 18.0 | |
| Nubian Resin Black Dye | 5.6 | |
| Carbon Black Pigment (Neo-spectra, Mark II) | 1.4 | |
| B. CARRIER PARTICLES | | 1,000 grams |
| C. Molybdenum disulfide (1% based on weight of carrier) | | 10.0 grams |

EXAMPLE III

| | | |
|---|---|---|
| A. TONER | | 100.0 grams |
| Ingredients | % By Weight | |
| Polyamide Rosin (Versamide 930) | 80.0 | |
| Moleic anhydride-polyhydric alcohol resin-modified resin (Amberol 800) | 7.0 | |
| Nigrosine Dye | 6.0 | |
| Polyols | 7.85 | |
| Carbon Black Pigment (Neo-spectra, Mark II) | 1.0 | |
| B. CARRIER PARTICLES | | 5,000.0 grams |
| C. Molybdenum disulfice (0.15% based on weight of carrier) | | 7.5 grams |

EXAMPLE IV

| | | |
|---|---|---|
| A. TONER | | 10.0 grams |
| Ingredients | by Weight | |
| Polyamide Resin (Versamide 930) | 33.0 | |
| Polyol (Shell X-450) (fluxing agent) | 9.8 | |
| Phenolic Resin (No. K-254) (Krumbhaay Chemical Div. Lawter Chemicals) | 49.5 | |
| Nubian Resin Black | 6.6 | |
| Carbon Black Pigment Neo-spectra, Mark II) | 1.0 | |
| B. CARRIER PARTICLES | | 1,000.0 grams |
| C. Titanium disulfide (0.1% based on weight of carrier) | | 1.0 grams |

EXAMPLE V
(Reversal Oriented)

| | | |
|---|---|---|
| A. TONER | | 100.0 grams |
| Ingredients | % By Weight | |
| Polystyrene Resin (Piccolastic D-100) | 57.0 | |
| Polystyrene Resin (Piccolastic C-125) | 37.85 | |
| Carbon Black Pigment 3018-L Sold by Ashland Chemical Corporation | 3.0 | |
| Heliogen Green Pigment (General Aniline) | 2.0 | |
| B. CARRIER PARTICLES | | 1,000.0 grams |
| C. GRAPHITE (0.15% based on the weight of carrier) | | 1.5 grams |

EXAMPLE VI

| | | |
|---|---|---|
| A. TONER | | 100.0 grams |
| Ingredients | % By Weight | |
| Resin-Modified Rosin (Amberol-800) (Rohm & Haas) | 54.0 | |
| Polyacrylic Resin (Acrylite BH-American Cyanamid) | 38.0 | |
| Nigrosine Black | 6.0 | |
| Carbon Black (ELF-5), Cabot Corporation | 1.85 | |
| B. CARRIER PARTICLES | | 1,000.0 grams |
| C. Molybdenum disulfide (0.15% based on weight of carrier | | 1.5 grams |

The developer mixes which have been formulated containing an additive selected from the group consisting of molybdenum disulfide, titanium disulfide, tungsten disulfide, and graphite, in accordance with the foregoing examples, have been found to produce high quality reproductions for as long as six hours continuous operation turning out from 40 to 60 copies per minute with high output duplicating machines. This amounts to the reproduction of from about 14,000 up to 21,000 copies, without evidence of significant developer mix fatigue. By contrast, under the same operating conditions developer mix formulations containing no fatigue resistance ingredient operates satisfactory over a period of only about three hours producing in the range of from 7200 to 10,800 copies.

What is claimed is:

1. A dry developer mix for developing electrostatic latent images comprising a mixture of carrier particles and pigmented thermoplastic resin toner particles and a particulate material additive selected from the group consisting of molybdenum disulfide, titanium disulfide, tungsten disulfide and graphite, and present in said developer mix in the range of from about 0.005 to about 1.0 weight percent based on the weight of said carrier particle, whereby said developer mix is capable of resisting fatigue for prolonged periods of time under high output duplicating machine conditions.

2. The developer mix as defined in claim 1 wherein said additive is molybdenum disulfide.

3. The developer mix as defined in claim 2 wherein said molybdenum disulfide is present in an amount within the range of about 0.05 to about 0.15 weight percent based on the weight of carrier particles.

4. A dry developer mix having improved fatigue resistance for developing electrostatic latent images comprising a mixture of carrier particles having an average particle size in the range of about 25 to 500 microns, toner particles having an average size smaller than that of said carrier particles, said toner particles consisting essentially of pigmented thermoplastic resin having an average size within the range of about 1 to about 10 microns, the relative proportion of carrier and toner particles being within the range of 10:1 to 100:1, and having included in said mix a particulate material additive from about 0.005 to about 1.0 weight percent selected from the group consisting of molybdenum disulfide, titanium disulfide, tungsten disulfide and graphite, based on the weight of said carrier particles.

5. In a dry developer mix for developing an electrostatic latent image on photoconductive, insulating material, comprising magnetic carrier particles and pigmented thermoplastic resin toner particles, the improvement resulting in a developer mix capable of resisting fatigue for prolonged periods of time under high output duplicating conditions, comprising from about 0.005 to about 1.0 weight percent of a particulate material additive selected from the group consisting of molybdenum disulfide, titanium disulfide, tungsten disulfide and graphite, based on the weight of said magnetic carrier particles.

6. The developer mix as defined in claim 5 wherein said additive is molybdenum disulfide and is present in an amount within the range of about 0.09 to about 0.15 weight percent based on the weight of said magnetic carrier particles.

7. The method of making a reproduction of a graphic original employing electrostatic copying techniques utilizing a photoconductive member comprising the steps of:

applying a blanket electrostatic charge to said photoconductive member; exposing said charged photoconductive member to a pattern of light and shadow to produce an electrostatic latent image thereon; applying a developer mix to aid electrostatic latent image comprising carrier particles and pigmented thermoplastic toner particles, and from about 0.005 to about 1.0 weight percent of an additive selected from the group consisting of molybdenum disulfide, titanium disulfide, tungsten disulfide and graphite based on the weight of said carrier particles.

8. The method as set forth in claim 7 wherein said additive is molybdenum disulfide and is present in an amount ranging from 0.09 to about 0.15 weight percent based on the weight of said carrier particles.

9. The method as set forth in claim 8 wherein said developer mix comprises a mixture of magnetic carrier particles having an average particle size within the range of about 25 to 300 microns, toner particles having an average size smaller than that of said magnetic carrier particles, said toner particles consisting essentially of pigmented thermoplastic resin having an average size within the range of about 1 to about 10 microns, the relative weight proportion of magnetic carrier and toner particles being in the range of 10:1 to 100:1, and from about 0.009 to about 0.2% of molybdenum disulfide based on the weight of said magnetic carrier particles.

* * * * *